US006036446A

United States Patent [19]

Goodman

[11] Patent Number: 6,036,446

[45] Date of Patent: Mar. 14, 2000

[54] FLUID TRANSFER WITH CONCURRENT SYSTEM MOVEMENT FOR LIQUID AND VACUUM

[75] Inventor: Lowell R. Goodman, 793 Swan Lake Ave., Belfast, Me. 04915

[73] Assignee: Lowell R. Goodman, Belfast, Me.

[21] Appl. No.: 09/039,358

[22] Filed: Mar. 13, 1998

Related U.S. Application Data

[63] Continuation-in-part of application No. 08/395,805, Feb. 28, 1995, Pat. No. 5,772,402.

[51] Int. Cl.[7] ..... F04F 19/24

[52] U.S. Cl. ..... 417/54; 417/53; 417/118; 417/122; 417/139; 417/143; 417/148; 137/15; 137/260; 137/403; 137/483; 137/488; 137/495; 184/1.5; 429/72; 429/80

[58] Field of Search ..... 417/54, 118, 122, 417/139, 143, 148, 53; 137/15, 488, 483, 495, 403, 260; 184/1.5; 429/72, 80

[56] References Cited

U.S. PATENT DOCUMENTS

| | | | |
|---|---|---|---|
| 3,741,240 | 6/1973 | Berriman | 137/483 |
| 4,095,672 | 6/1978 | Senese | 184/1.5 |
| 4,258,747 | 3/1981 | Trobaugh | 137/488 |
| 5,405,247 | 4/1995 | Goodman | 417/139 |
| 5,731,099 | 3/1998 | Badger et al. | 429/72 |
| 5,772,402 | 6/1998 | Goodman | 417/118 |
| 5,878,767 | 3/1999 | Etling et al. | 137/15 |

*Primary Examiner*—Mark Paschall
*Assistant Examiner*—L. Fastovsky
*Attorney, Agent, or Firm*—Stan Jones, Patents

[57] ABSTRACT

A portable system of inter-connected smaller and larger canisters for near simultaneous vacuum and liquid transfer free from any external power. Captured vacuum in the canisters is employed for waste liquid extraction and a subsequent pressure transfer may take place without any liquid being exposed to the atmosphere. A mechanical manifold is adapted to receive the canisters, and one or more canisters may be physically connected to the manifold and are left in place as a user drives to another site location. An intermediate canister in the system is fitted with either manual or a self tending valve for the vacuum and pressure modes of the system.

42 Claims, 11 Drawing Sheets

Block Diagram - Mobile, Portable Rechargeable System

FLUID TRANSFER WITH CONCURRENT SYSTEM MOVEMENT FOR LIQUID AND VACUUM

My invention of U.S. Pat. No. 5,405,247 ('247 patent) entitled Pre-charged Vacuum Fluid Charge/Disposal Apparatus, issued in April, 1995 on an original application filed in 1990. This continuation-in-part is from my divisional application of the same title filed on Feb. 28, 1995 having Ser. No. 08/395,805 scheduled for issuance shortly now U.S. Pat. No. 5,772,402.

BACKGROUND OF THE INVENTION

Field of the Invention

The invention relates to the field of fluid handling, and more particularly to a portable, self-contained vacuum extraction and liquid handling method and system. Further, the field relates to vacuum and pressure liquid handling which share a common closed system for controlled liquid, vacuum and/or pressure transfer between several containers.

Finally, the field relates to a fluid handling system of smaller hand portable canisters, intermediate canisters, and mobile transfer of fluid type products to larger reclamation storage tanks. The field also relates to canisters which may readily be connected and disconnected at will within an overall liquid, vacuum and pressure transfer system method and apparatus.

EXPLANATION OF TERMS

Certain terms are used to introduce and explain the background of the art and the invention; and, for convenience and completeness sake, such terms are summarized in this section. These terms are not meant to supersede the claims nor the definition of terms as defined within the four corners of the specification; but, rather, are meant to further the understanding of the invention and briefly introduce the stage for a detailed teaching of the improvement in the art as provided by this invention.

Such terms include the following:

Smaller Canister.

A hand portable, sealable container capable of capturing and holding a high (perhaps a near absolute) vacuum, which is used for fluid extraction from a sump. As an example, such sump fluid may be waste liquid extraction from remote engines that are typically found off site from a waste receiving reservoir. In one preferred application such a canister finds primary importance where there may not be on site electric or some other similar non-system power source which is readily available. Such a canister is also capable of being pressurized above fresh liquid for replenishment of such fresh liquid in the void left by the withdrawal from a sump such as a remote engine.

Intermediate Canister.

A sealable container of larger volume—on the order of perhaps ten times larger than the smaller canister(s)—which is capable of capturing and holding a high vacuum and/or positive pressure. This container may be fixed or mobilized in order to provide increased field flexibility. Although not normally hand portable, mobility of the intermediate container by truck, van or the like may allow waste fluid/oil (or other such liquids) to be transported to a large disposal and/or reclamation center without such liquids being exposed to the atmosphere.

System.

A collection of one or more relatively small canisters, and an intermediate container which is preferably larger in size together with valves, piping and manifold connection apparatus required for user-controlled fluid transfer. The system provides easy recharging capability and is highly efficient for waste oil and/or vacuum/pressure transfer between the canister(s) and the intermediate container.

Closed System.

A closed system, for purposes of this invention is one whose functions are contained and/or performed by and within the physical bounds of the entire apparatus. Likewise, the power or energy source is contained within the physical bounds of the device. Within the framework of this invention, portions or segments of the closed system may be "borrowed" and taken to an alternate site to perform a function or sub-function: however, that borrowed portion, operating off-site is still defined as being within the bounds of the closed system. When used herein, closed system does not simply mean that a certain, last valve has been shut (Valve operations only seal the system, or a portion thereof, in order to maintain system integrity.)

Waste Receiving Reservoir.

A waste receiving reservoir is a reclamation type tank or storage that is reserved, normally at a fixed central location, for receiving waste fluids/liquids. Such a reservoir is typically reserved for a receiving station, and may involve a larger storage tank in its simplest form or could involve a more sophisticated reclamation center. This reservoir may typically have a storage capacity on the order of several hundred gallons.

Sump.

The sump is the container device that is to be evacuated, normally by use of a captured vacuum into a small hand portable canister. The system can, of course, also refill and otherwise treat fluids necessary in the course of refilling and/or otherwise servicing such sumps. Although normally liquid—such as engine oil—the invention has strong application to air conditioners, gasoline tanks, hydrocarbon containers and similar devices to name just a few uses.

Pump or Pumped Down.

The act or end result of evacuating one or all canister components of the system to a pre-determined vacuum. (Please see the other related vacuum definitions and descriptions herein as read in the light of the entire specification and claims.)

High Vacuum.

A high vacuum may with the vacuum pumps of today be obtained in the range of about 20 to 29.92 inches, with markedly increased system efficiency at those vacuums approaching a near absolute vacuum. (Please see Starting Vacuum and Percentage Fill below.)

Three Way Manual Valve.

A manually operable single lever valve capable of isolating a pressure path from a vacuum path and simultaneously exposing either, but not both, to a void such as provided in an intermediate canister and/or the interconnected system of multiple canisters.

Pressure Source.

Such a pressure source may include a nominal 90 to 150 PSI shop or service station air supplied from an air compressor to drive the vacuum pump for the system. The pressure source may also include relatively a smaller high pressure canister as a system module.

Pressurized.

The act or operation of pre-charging an intermediate canister for pressure-assisted liquid transfer to a larger unit. Also a positive pressure condition which may be created from a dedicated optional canister or low pressure source available within the overall system.

Self-Tending Pressure/Vacuum Check Valve.

This valve is a self-tending pressure or vacuum capturing device which eliminates the requirement for a manual valve operation by a user desiring to switch from a vacuum mode to a pressure mode. Operator error involved in switching between modes is eliminated by this self tending valve, which valve automatically captures and holds a predetermined vacuum or pressure above a minimum threshold in a system container. Although superficially similar in appearance to a commonly known shuttle valve, new structure and functions are achieved by the self tending valve.

Vacuum Pump.

In the preferred embodiment, the vacuum pump is a two stage air pressure driven venturi vacuum pump, attached and/or integrated into the system, and powered in a temporary mode by any pressurized air source. (An electrical vacuum pump, or other such suitable source is equally acceptable for pumping the system.)

Service Period.

A field operational time period wherein a user operates the system without external forces or motors for a dozen or more times in order to thereby transfer and recharge the smaller canisters while performing multiple sump extractions throughout the service period. Smaller canisters are carried to and from sump locations and the intermediate canister. This intermediate canister may advantageously be mobilized by a small truck, a hitch or similar mechanism.

Starting Vacuum & Percentage Fill.

The system starts with a predetermined high vacuum that may—but need not be—as high as a near absolute vacuum. Percentage fill is favorably non linear with such a high starting vacuum. This high vacuum is dissipated but very little by repeated evacuations of waste oil that is then self contained in canister(s) and/or in an intermediate storage. From an overall system standpoint, starting with such a high vacuum, the percentage fill may reach a theoretical 99 percent. Certain specific examples are given in the specification.

Differential Vacuum.

A differential vacuum is the positive and/or negative difference that exists when two separate vacuums are compared or connected together. Such a differential vacuum may thus assist in the transfer process described herein.

DESCRIPTION OF THE PRIOR ART

In recent years, the Environmental Protection Agency ("EPA") has identified oil and related liquid petroleum products as a hazardous waste. Thus, the methods of handling small to medium quantities of such liquids in routine servicing operations, without spillage and/or—where possible—without human contact, has come under increasing scrutiny. Eliminating points of human error—such as manual valves or atmospheric exposure of toxic waste—is deemed highly desirable by environmentalist groups.

Oil spills in oceans, rivers, lakes and streams were the first to draw attention to the environmental damage that such spillage may cause. Studies have shown the ground water contamination from oil and related liquid petroleum products is a dangerous matter. One gallon of petroleum-type spillage may contaminate up to 1,000,000 gallons or more of ground water. Even small quantities of oil and gasoline involved in lawn mowers and other non-automotive machinery has come under EPA regulations. Atmospheric concerns have led to hydrocarbon issues such as elimination of freon air conditioners and the like.

My issued '247 patent covers a Slurper® product that has experienced widespread use in marine and other small engine oil handling situations by virtue of a portable vacuum which suctions and simultaneously self contains several gallons of used engine oil. All the Slurper® advantages were achieved by a pre-charged vacuum-driven unit that did not require local power for its use. The Slurper® was awarded a Governmental grant and has been received with significant commercial success at individual and/or isolated Marinas and similar sites.

During a routine service period, the total amount of oil that must be withdrawn from several marine engines is often greater than that which can easily be handled by one portable Slurper®. Thus, field uses have appeared which present medium-sized waste oil opportunities that may not readily be handled by one Slurper®. As an example of one such field use, let us look at a marine dock having several vessels to be serviced. As a Slurper® is filled, it becomes necessary both to drain the waste oil from the Slurper® and to recharge the contained vacuum such that repeated oil suction operations can take place.

Often the waste oil content from a Slurper is poured into a five gallon bucket if the Marina does not have access by piping directly to an oil disposal center. The above-described field use may further involve pouring drained oil from five gallon buckets to some other container such as a 55 gallon drum. These practices unnecessarily expose the waste liquid to the possibility of oil spillage during repeated open air transfers. Ideally one would hope to achieve such transfers without any spillage possibility or open air exposure at all.

A critical need has thus been identified for handling and containment of medium-sized quantities of liquid waste. Of paramount importance to the fulfillment of such a need is a safe, self-contained method together with a fool proof and efficient apparatus for handling waste oil. This expansion of existing Slurper™ technology extends the envelope of safe oil handling in that it simultaneously provides a pre-charged system which receives and contains, multiple but time-separate transfers.

In this continuation-in-part invention, I am building upon my earlier patented work. In so doing, I respectfully submit that none of the known prior art discloses or suggests a self-tending, closed system for "borrowing" small amounts of vacuum from a much larger vacuum container while concurrently transferring suctioned waste liquid into the larger container from a variety of smaller canisters.

SUMMARY OF THE INVENTION

A total fluid handling system approach—together with individual items of apparatus making up the system—is disclosed and claimed herein. The system is a closed one involving the method of borrowing vacuum in small quantities via a mechanical manifold connector to and from a tank having therein a larger contained vacuum. This vacuum borrowing, or recharging, takes place while concurrently exchanging small quantities of waste liquids between the smaller canister(s) and the larger contained vacuum. These containers in my system are temporarily manifolded together for a near simultaneous or essential concurrent automatic exchange and automatic transfer of both fluids such as waste liquid and vacuum. Manifold variations together with valve conditions may also accommodate pressure and/or vacuum for the claimed system.

An intermediate mobile container is configured as a "parent" container which includes a pre-charged major source of system vacuum. The smaller hand canisters are configured as "children" who are brought by the user to the "parent" both for purposes of vacuum recharging and waste oil transfer. Thus, I have discovered that one or more pre-chargeable, sealable, smaller canisters may be placed in temporary, bi-directional fluid communication with an intermediate evacuated canister.

In accordance with my portable system invention, a closed fluid system exchanges vacuum and liquid contents through a mechanical manifold. The manifold may simply be a sealed conduit that is preferably positioned at a higher elevation than an intermediate tank and connects a bottom outlet of one or more smaller canisters through a sealable quick mechanical connect/disconnect apparatus. This manifold may be manually valved to a top entry port on the intermediate storage tank. One or more smaller canisters may remain sealably connected to the manifold during transit of a mobile intermediate container to another site location.

With the smaller canisters in fluid communication with the intermediate container via the manifold, a transfer of waste liquid to the intermediate canister, and vacuum replenishment of the smaller canisters can occur while the user is moving to a new site. Thus, self tending liquid transfer is readily accomplished, in a mobile environment within a closed system, and exposure of the waste liquid to the atmosphere is completely avoided. Potential liquid spillage problems that have plagued the prior art before the development of this invention are solved by my novel method and apparatus.

The waste liquid—marine engine oil, for example—may later in time be transferred from the intermediate canister to a waste reclamation reservoir at a disposal site. None of such transfers need be exposed to the atmosphere. Thus, the system containers may advantageously be mobilized for servicing several remote sites via the smaller, hand portable Slurpers™. Portable transfer of waste liquid from a sump to a smaller canister and thereafter in a sealed environment to an intermediate canister is achieved.

My system method and apparatus eliminates the need for motors, pumps, or electricity at service sites, and eliminates any open atmosphere pouring and/or electrically driven pumping during transfer from smaller canisters into intermediate storage unit(s). In the case of more volatile hydrocarbons, such as gasoline, evaporation to the atmosphere is also totally eliminated. I have discovered that many advantages of my techniques apply to air conditioning, hydrocarbon handling and many similar related fields. Waste spillage chances are reduced, and the ideals of a spill proof environment are closer to practical realization in accordance with the principle of my invention.

OBJECTS OF THE INVENTION

It is an object of the invention to provide a removable, hand portable container for remote site vacuum suctioning of waste liquids for vacuum delivering of such liquids to another container.

It is an object of the invention to provide a larger spill proof container to receive waste liquid during a vacuum/liquid exchange.

It is an object of the invention to provide a pressure or vacuum mode for canisters in a closed vacuum/liquid interchange system.

It is a further object of the invention to provide a method of transferring waste oil from a smaller hand portable canister to a sealed intermediate canister through a sealed connector.

It is another object to provide a means of transferring a waste liquid from a smaller canister into an intermediate canister which contains a captured vacuum while concurrently vacuum charging the smaller canister.

It is still one further object of the invention to transfer a waste liquid into an intermediate canister containing a vacuum, without losing any vacuum in the smaller canister.

It is an object to provide an apparatus for liquid transfer between sealable containers within a common shared vacuum which is equalized between the two containers during a near simultaneous or essential concurrent automatic vacuum/liquid exchange.

It is an object to provide a method of recharging a smaller canister with a contained vacuum multiple times during a service period without benefit of air pressure, a vacuum pump or other similar external power source.

It is yet a further object of the invention to provide a system with a near absolute vacuum for a very high percentage fill in the order of 95 percent between containers in a closed system.

It is an object, to provide pre-charging of a two stage venturi vacuum pump capable of pumping an interconnected component vacuum and/or liquid system to a near absolute vacuum.

It is an object to provide a system which may use air pressure as the only energy source for pre-charging the system with a large volume of vacuum available for smaller portable vacuum withdrawal and concurrent delivery of waste oil or similar liquids drawn from sumps into one system container.

It is an object to provide a multi tank vacuum system, wherein, smaller amounts of vacuum may be taken by increments from a larger pre-charged vacuum tank as desired.

It is an object to provide a multi tank system including one tank of captured pressurized air, wherein, smaller amounts of pressure may be incrementally taken from the one pressure tank as desired.

It is an object to provide a system capable of a dozen or more oil changes and transfers using only a single system vacuum charge, with such a charge lasting on the order of a full service period, which period may be in the order of a day or more.

It is an object to provide a closed vacuum and gravity feed system wherein liquid transfer from a smaller canister to a larger canister is sealed from the environment and is self tending.

It is an object to provide system method and apparatus wherein the user may choose to exchange some system vacuum loss for differential vacuum transfer at an increased speed of operation.

It is an object to provide a system with differential vacuum transfer capability, thereby transferring liquid between sealed smaller canisters upward against gravity with only a relatively small total system loss of vacuum.

It is yet one other object of this invention to assure both pressure and vacuum as needed in one sealable, compartmentalized, manifold-connected, modular system useful for suctioning, containment and interim transfer of waste products without exposing any such liquids/fluids to the atmosphere and without external power.

It is another object of this invention to assure a self tending valve capable of handling and capturing either pressure or vacuum as needed in one container.

It is one further and final object to either evacuate or pressurize a container by a self tending ball capturing valve which operates free of manual valves in either the vacuum or pressure mode.

BRIEF DESCRIPTION OF THE DRAWINGS

FIG. 1 is a small single-compartment vacuum Slurper™ as disclosed and claimed in my parent and divisional patent applications, the parent having issued as the '247 patent.

FIG. 8 includes FIGS. 8A and 8B wherein FIG. 8A is a representation of a multiple unit canister system connected to a manifold, and FIG. 8B shows a representative quick connect/disconnect coupling useful in the manifold connector for my system.

DESCRIPTION OF PREFERRED EMBODIMENT(S)

Figure 1:
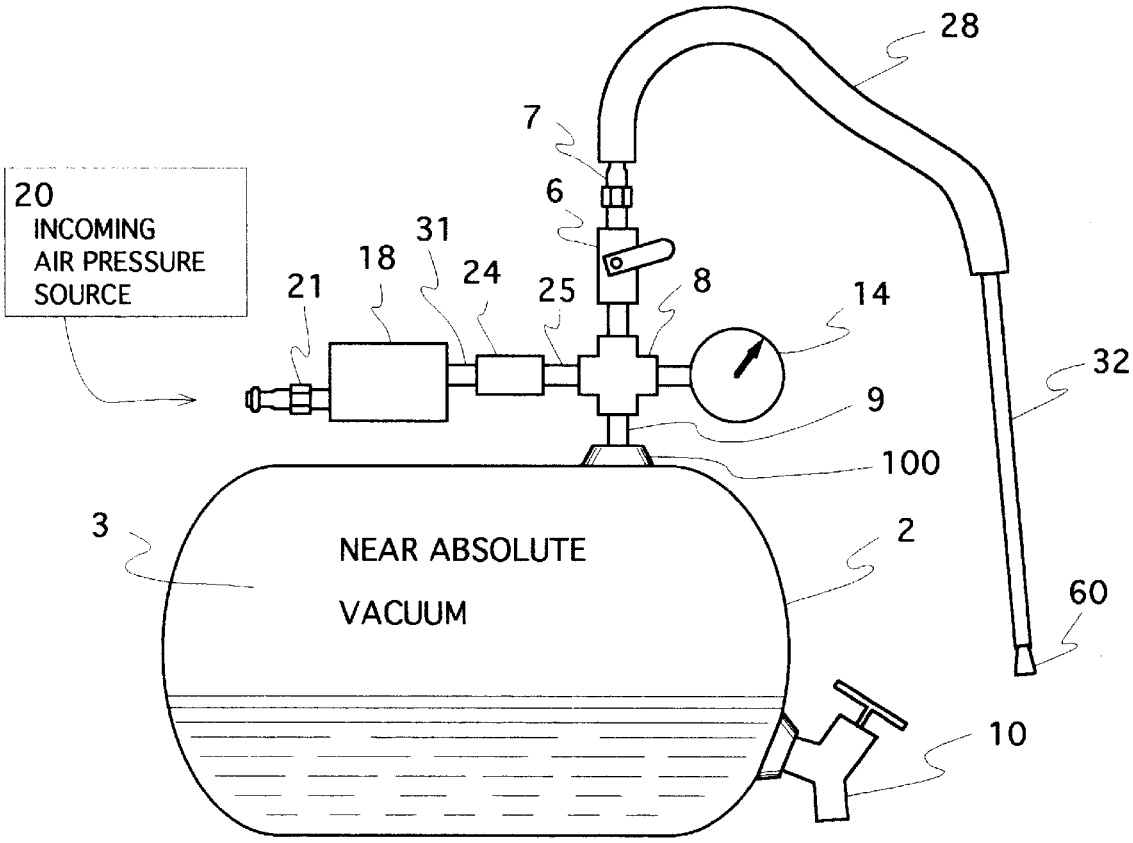
FIG. 1 includes FIG. 1A.
Figure 1A:
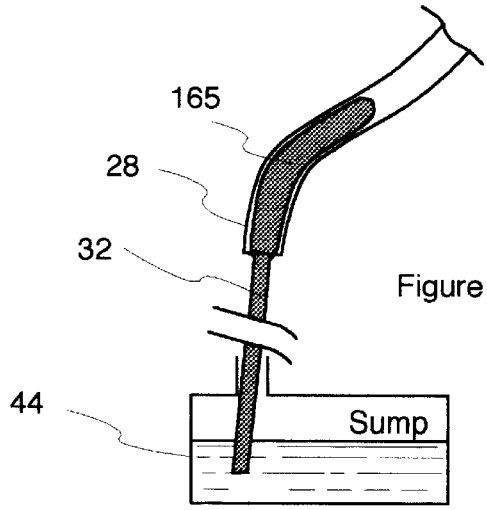
FIG. 1A discloses a sump source and a transparent withdrawal tube as also disclosed and claimed in the '247 patent.
Figure 2:
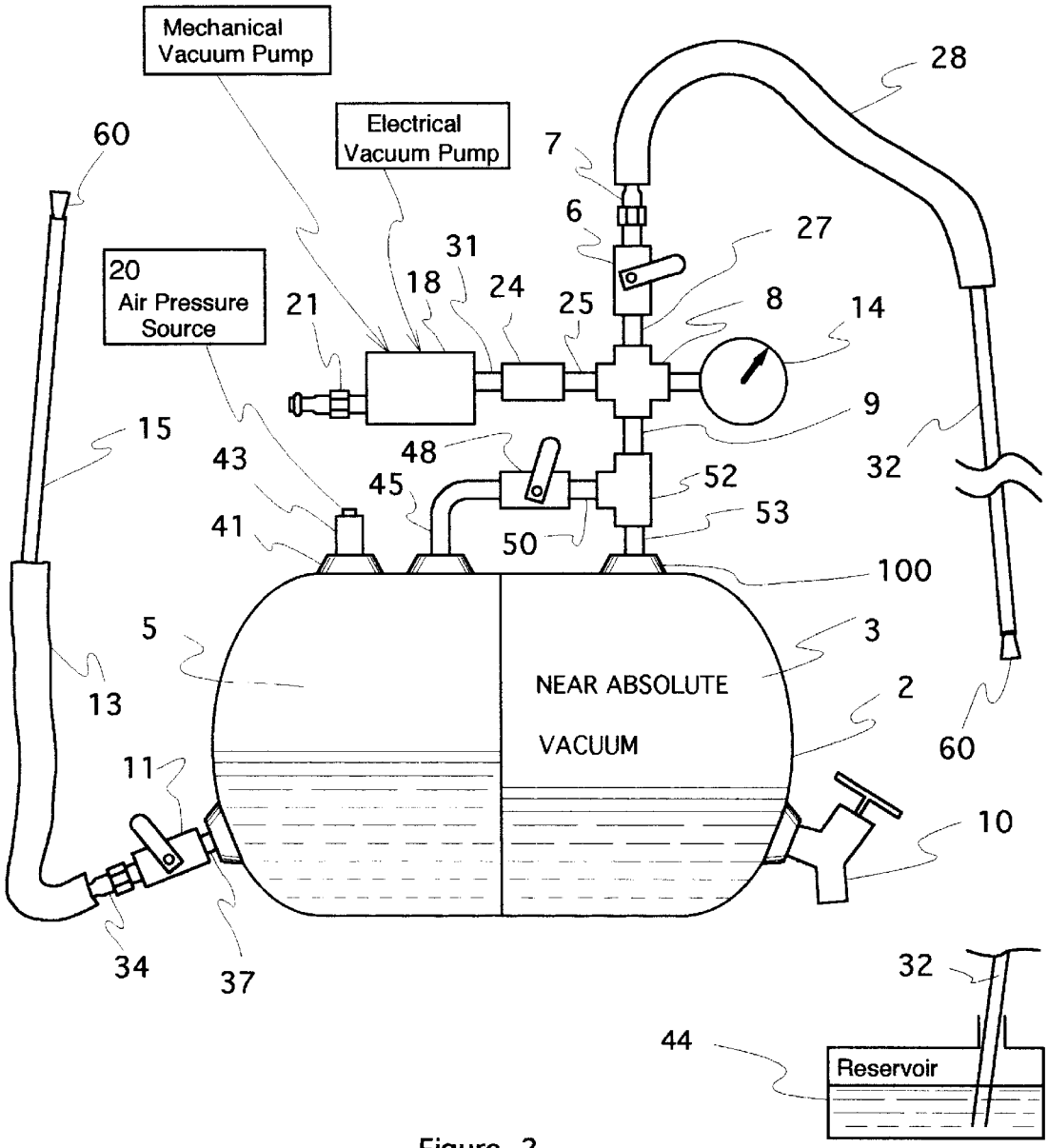
FIG. 2 is a small two-compartment vacuum/pressure Slurper™ as disclosed and claimed in my parent and divisional patent applications.

For purposes of brevity in this continuation-in-part application, I will only summarize the operation fully set forth in my earlier '247 patent. Nevertheless, I hereby incorporate the entire specification and the claims therein as though set forth in full at this point. With such incorporation in mind, assume in FIG. 2, for example, that side 5 of tank 2 is reserved for fresh oil and side 3 is reserved for waste oil.

In my earlier patented invention, a compartmentalized tank 2 having compartments 3 and 5 in any suitable tank construction is claimed. In the tank configuration, compartments 3 and 5 are shown as essentially equal in size, but need not be. The attached pipes and valves allow both a finite vacuum and/or a finite pressure to be stored in the compartments 3 and 5 of tank 2 depending upon the particular field service requirements.

In my preferred operation, I first evacuate both compartments 3 and 5 so that fresh fluid—such as, for example, oil—can be drawn into compartment 5. (Also, compartment 5 can simply have fresh oil poured into it through an opening such as 37 or the opening created when an element, such as, for example, element 41 is removed or adapted in a suitable manner. I prefer, however, that compartment 5 be vacuum evacuated and fresh oil drawn in by vacuum.) Compartment 5 is then pressurized by an incoming air source 20 via the air valve 43 to approximately 20 pounds per square inch (20 psi). Fresh oil is then under pressure when a fill is needed in a sump, shown simply as reservoir 44.

Element 18 is either an air driven double or multi-stage venturi vacuum pump, or it may be a mechanical or electrical pump capable of pulling a high vacuum in the neighborhood of between about 20 to 28 inches of mercury, with the higher value being better for the reasons explained herein. If pump 18 is of the multi-stage air driven type, then element 21 is a coupling for receiving an air supply of any given type such as, for example, a shop or service station air supply shown simply as pressure source 20.

Nipples 31 and 25 connect the vacuum pump 18 to a cross tee connector 8 via a vacuum check valve 24. An air pressure or a well known combination pressure/vacuum; gauge 14 is also connected to cross block 8. Gauge 14 is capable of reading the conditions of either compartment 3 or 5 depending upon the way that valve 48 is set.

Reservoir 44 is assumed to depict a sump such as an engine in a marine vessel that may be in the water and not near any outside electrical power source. A contained and captured high vacuum in compartment 3 is available to pull the waste oil from sump 44 as fully described via dip stick insert tube 32. Tube 15, in turn, can then be used to insert fresh oil in the sump 44.

My '247 patent/parent application fully depicts and describes several valve variations for ease of accomplishing these fundamental objectives, and such further operations need not be repeated here. My patented invention, as is this system, is capable of many diverse uses. In its broadest sense, my invention has proven commercially valuable for fluid transfer of many varied types of fluids such as engine oils, gear box lubricants, diesel fuel, gasoline, and air conditioning refrigerants. For purposes of explanation herein, however, I will concentrate mostly on liquid transfer such as engine oil. My patented Slurper™, however, is by no means limited only to engine oil.

For a marine engine oil removal, my Slurper™ is readily portable to a marina dock in our assumed example. A technician may have multiple engines to suction during one service period. After suctioning two or three engines with a typical Slurper, he must then empty the waste oil into yet another container and further, may not have readily accessible air pressure for recharging his Slurper vacuum. My new and novel invention herein solves both of these field problems.

Figure 3:
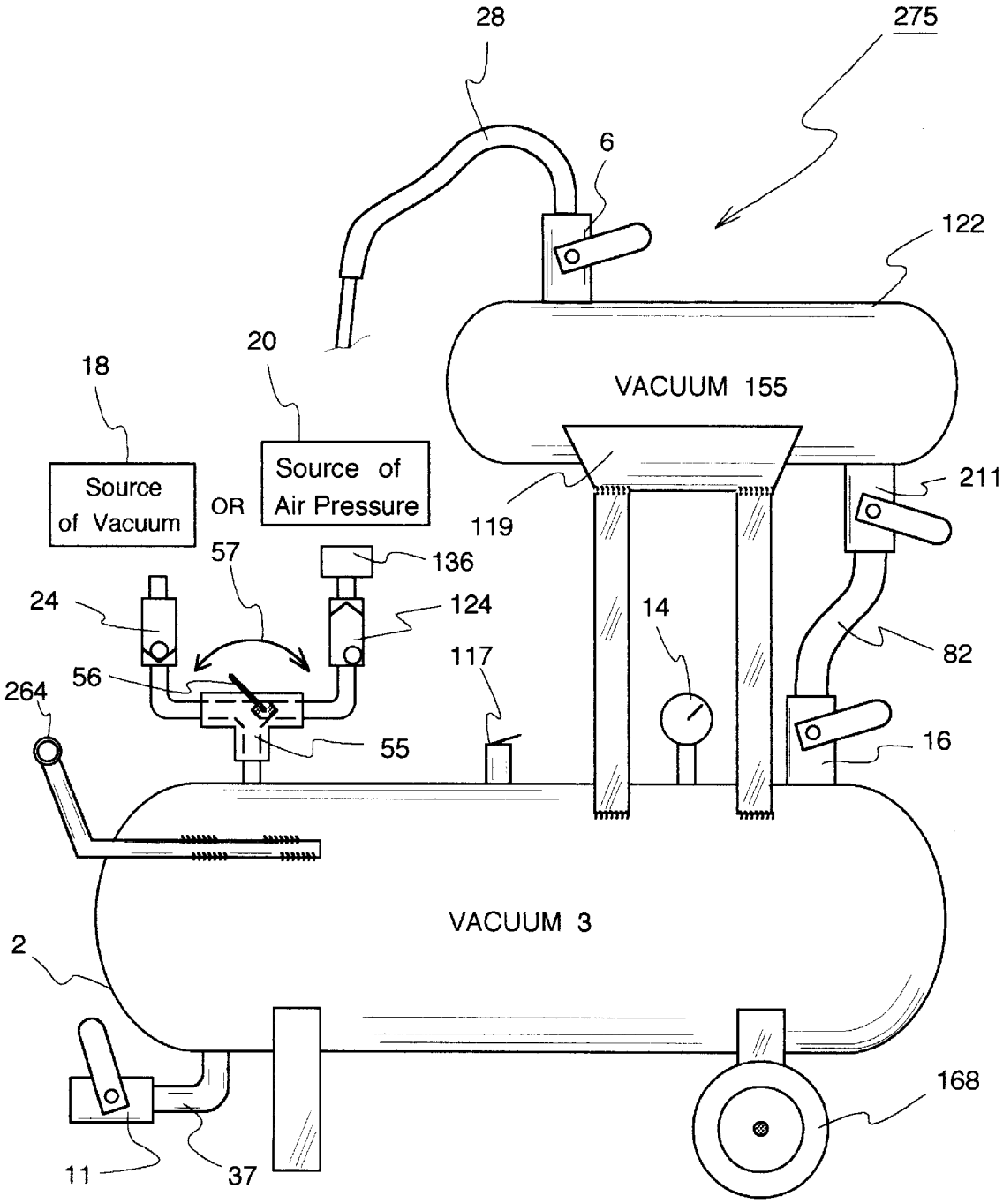
FIG. 3 is a system including tankage and valve representations of the functions and methods associated with FIGS. 1 and 2.

FIG. 3 presents system 275 with all valves configured for vacuum pre-charging. As will be appreciated by the description hereinafter, the difference in my canisters 2, 122, etc. in certain field operations is often only tank size. In FIG. 3, assume that tank 2 is sized on the order of about 50 gallons, but could be 100 gallons or more. These major system components 2, 122, have been air evacuated, creating internal vacuum 3 within canister 2 and an equivalent vacuum 155 in tank 122.

Such evacuation (sometimes referred to herein as vacuum pump-down) involves closing valves 6 and 11, and positioning the three way valve 55 as shown. In this vacuum pump down mode, three way valve 55 exposes the void 3 to vacuum source 18, through a high vacuum check valve 24. The three way valve 55 isolates check valve 124 located in the pressure circuit that leads to air pressure source 20. Valve 16 of canister 2 also remains open. Correspondingly, bottom valve 211 of smaller canister 122 is open, with valve 6 being closed, thereby placing void 155 in smaller canister 122 in temporary vacuum communication via conduit 82 with void 3 of intermediate canister 2.

With vacuum pump down complete, system 275 is now pre-charged for field use. Valves 211 and 16 would normally be closed at this point to protect against accidental vacuum loss. Although wheels 168 are shown, intermediate tank 2 may in fact be fixably mounted in a box van or pickup, thus creating a mobile system 275. In such a configuration, system 275 is now, pre-charged and mobile, with sub-components also pre-charged, and uniquely hand portable.

Once mobile system 275 has been transported to the field, the user is free to remove smaller canister 122 from saddle 119 for hand portable remote suctioning operations. The user does so by closing valves 211 and 16, then disconnecting hose 82 from the bottom of valve 211 by hand using any industry standard tubing and/or quick disconnects (not shown), and subsequently hand carrying canister 122 to a sump.

Figure 4:
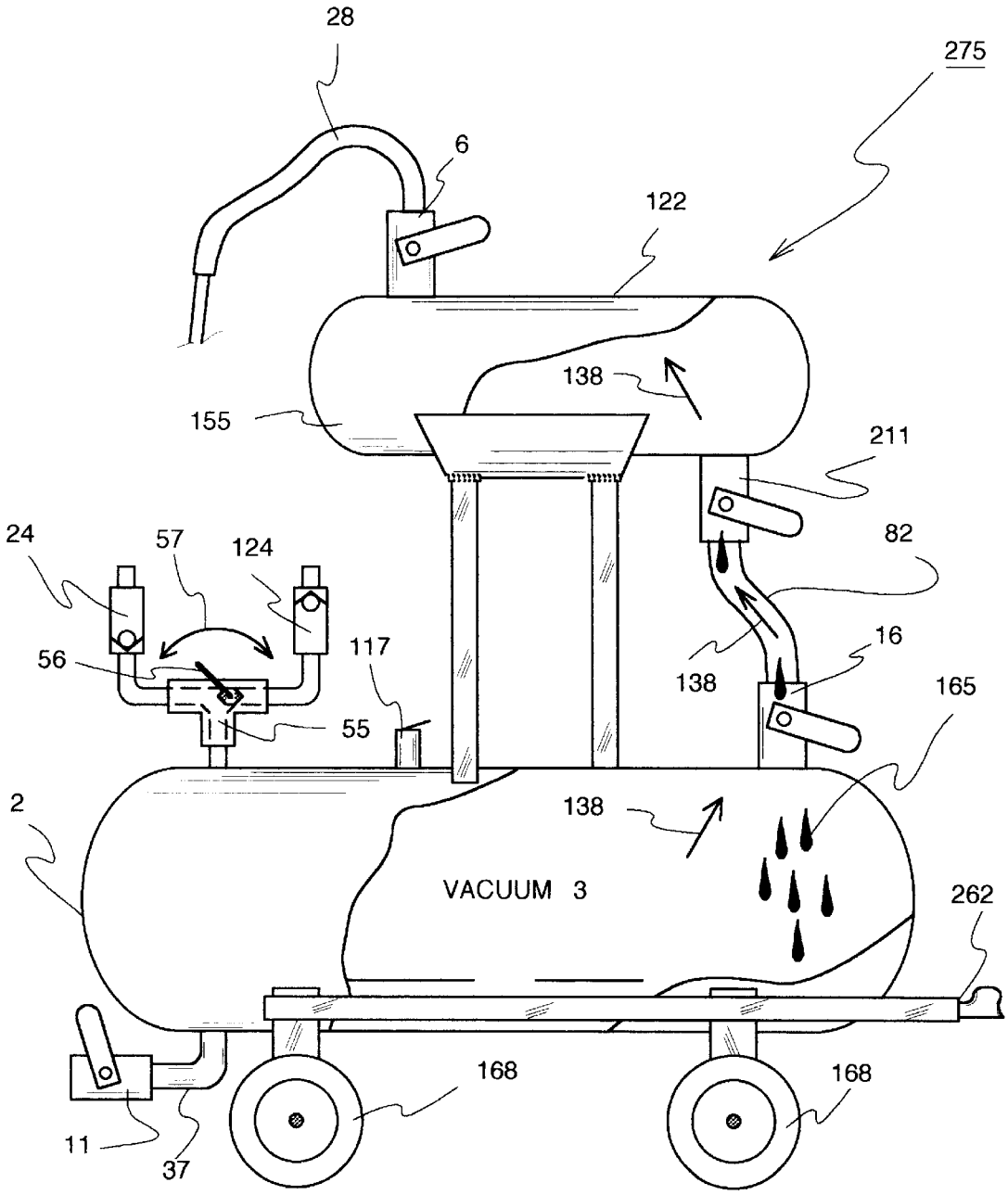
FIG. 4 represents a containerized concurrent vacuum/liquid transfer operation.

Once the user returns from a field suctioning operation, with smaller canister 122 full of waste oil, the key elements in FIG. 4 are revealing. The user simply reconnects canister 122 via valve 211 to hose 82, leaving top valve 6 closed. He then opens valves 211 and 16. With the valves configured as stated, waste liquid (drops 165) gravity transfer downward from hand portable canister 122 into parent canister 2. Nearly simultaneously, vacuum (arrow 138) contained and shown as void 3, transfers upward, and into canister 122, thereby recharging same for another hand portable field suctioning operation. (Technically, the vacuum has simply equalized between tanks 2 and 122 as it did in its original pre-charging operation.)

In simplistic terms, the user has been able to sealably "pour" his small amount of waste liquid 165, from canister 122 into intermediate canister 2, totally "within" a vacuum, and near simultaneously "borrow" more vacuum from canister 2, all without using any external power source whatsoever. System 275 may thus provide to the user several time separate transfers in the field during an extended service period, operating solely from his one and only pre-charging operation of the entire system at his shop prior to departure to the field.

Please note that tank 2 is shown in FIG. 3 with wheels 168 providing mobility typical of a shop model. Of course system 275 in any of my embodiments shown could also be pulled as a trailer by using hitch 262 as shown in FIG. 4. Quite obviously the large volume of vacuum in intermediate tank 2 is several times that of the smaller portable unit 122. Thus, many such essentially or near simultaneous transfers may take place before significant vacuum will be diminished in the intermediate tank 2.

Optimum system performance is effected by pumping down to a high, and preferably, a near absolute vacuum at the start of a mobile service period. My two stage air driven vacuum pump 18 will pull system 275 down to 29.7 inches of mercury. At such a starting vacuum, system tankage comprised of the combined void 3 of tank 2 and void 155 of canister 122 will fill with waste liquid to a theoretical 99% of its total combined volume. Under practical field conditions, 275 will suction, and contain waste fluids to a level over 90% of system volumetric capacity.

Thus, with careful attention to starting vacuum, I have developed a system which is very favorably non-linear in terms of system vacuum charge remaining vs. percentage fill. By explanatory example, when my combined system vacuum is exposed only to liquid (under ideal conditions, with no air intervention) system 275 would receive and contain over 50% waste liquid with only a one inch reduction of vacuum.

Given that void 3 of tank 2 has now received multiple transfers of waste oil from canister 122 etc, to the point of being near full, this larger quantity of oil must be delivered to another—larger, site specific—tank (not shown). Moving now to FIG. 5, emptying of tank 2 may be accomplished by simple gravity draining through valve 11 connected to a waste receiver. However, many larger on site storage tanks have an inlet elevation which exceeds the outlet elevation of valve 11. Therefore, my invention also provides a pressure assist method and apparatus for expulsion of waste liquid from the parent canister 2 for subsequent safe, spill proof transfer to a larger on site storage unit.

Figure 5:
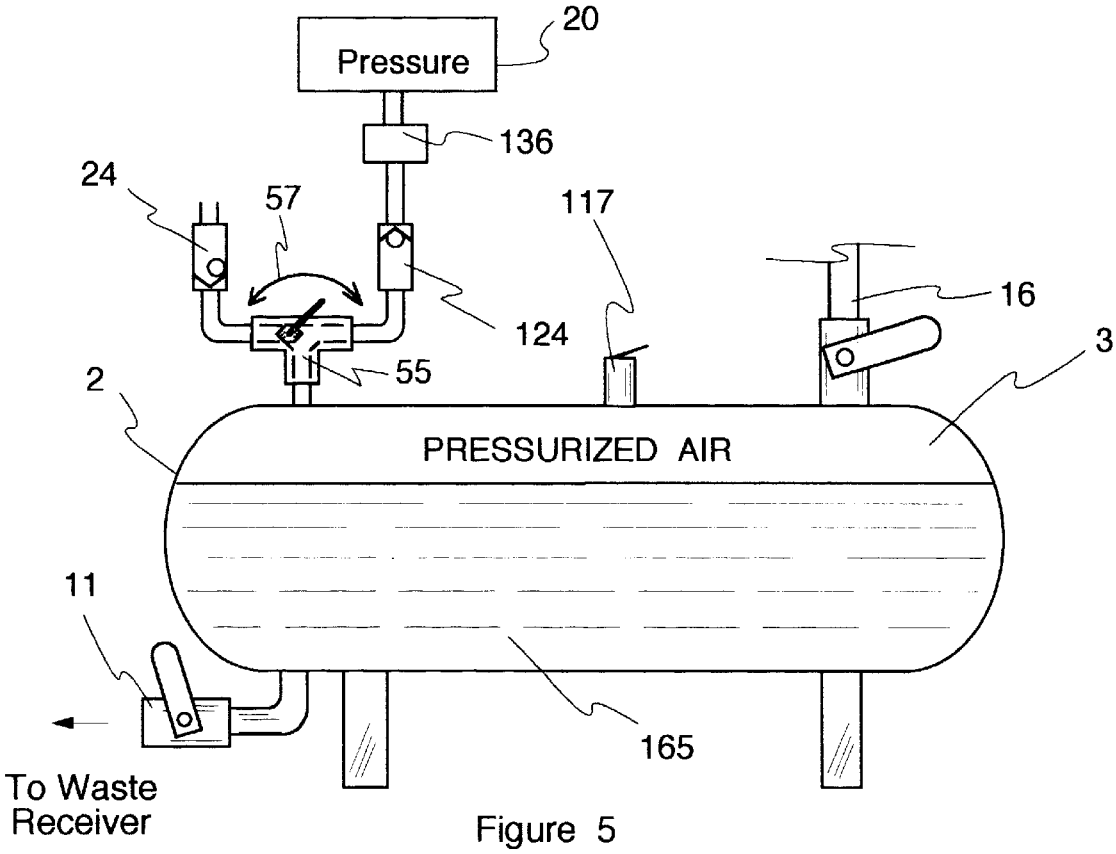
FIG. 5 discloses a system configured for pressure mode transfer operations.

As shown in FIG. 5, a manual change in handle valve 55 along arrow 57 is made, causing valve 55 to isolate and seal off the vacuum input side, and expose void 3 of tank 2 to a pressurized air source 20. Void 3 receives pressurized air above the waste liquid up to the pressure controlled by a pressure regulator 136. Once equalized to the preset regulator pressure, source 20 may be disconnected, wherein check valve 124 captures the pressure in void 3 above waste liquid 165.

Thus, canister 2 is now pre-charged for pressure assist during transfer. This pre-charged pressure mode further provides a method and apparatus for final transfer without the requirement of a continuously connected air source. A transfer hose (not shown) is connected between valve 11 and a larger storage tank. Once valve 11 is opened, liquid transfer is made under a controlled pressure, thereby emptying tank 2.

Figure 6:
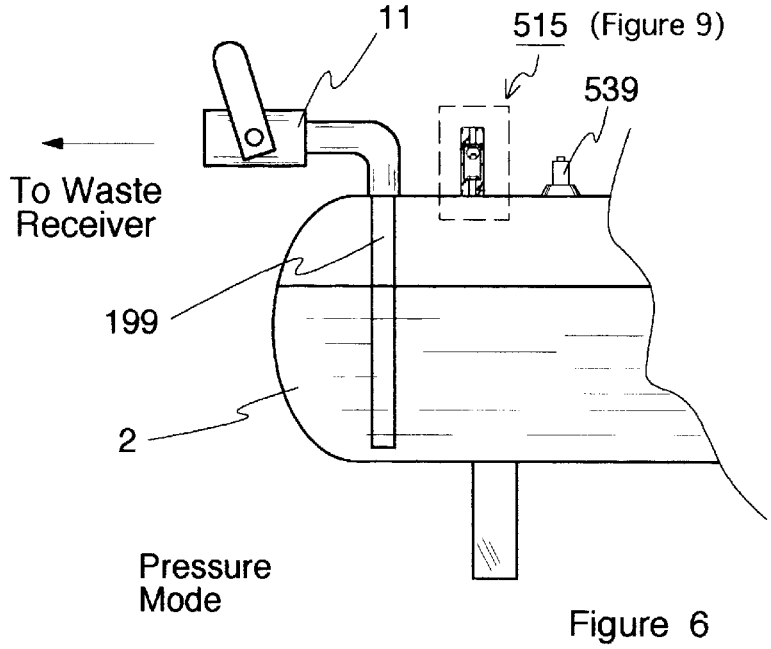
FIG. 6 is a stand pipe pressure transfer variation of FIG. 5.

In yet another embodiment shown in FIG. 6, internal standpipe 199 is provided between void 3 and valve 11. Standpipe 199 thereby provides an additional measure of spill protection, eliminating the chance of an accidental opening of valve 11 in the field. Certain environmentally sensitive areas, such as marine areas, prohibit the use of tankage with any bottom located valves whatsoever, and thus a standpipe is essential for such areas.

Figure 7:
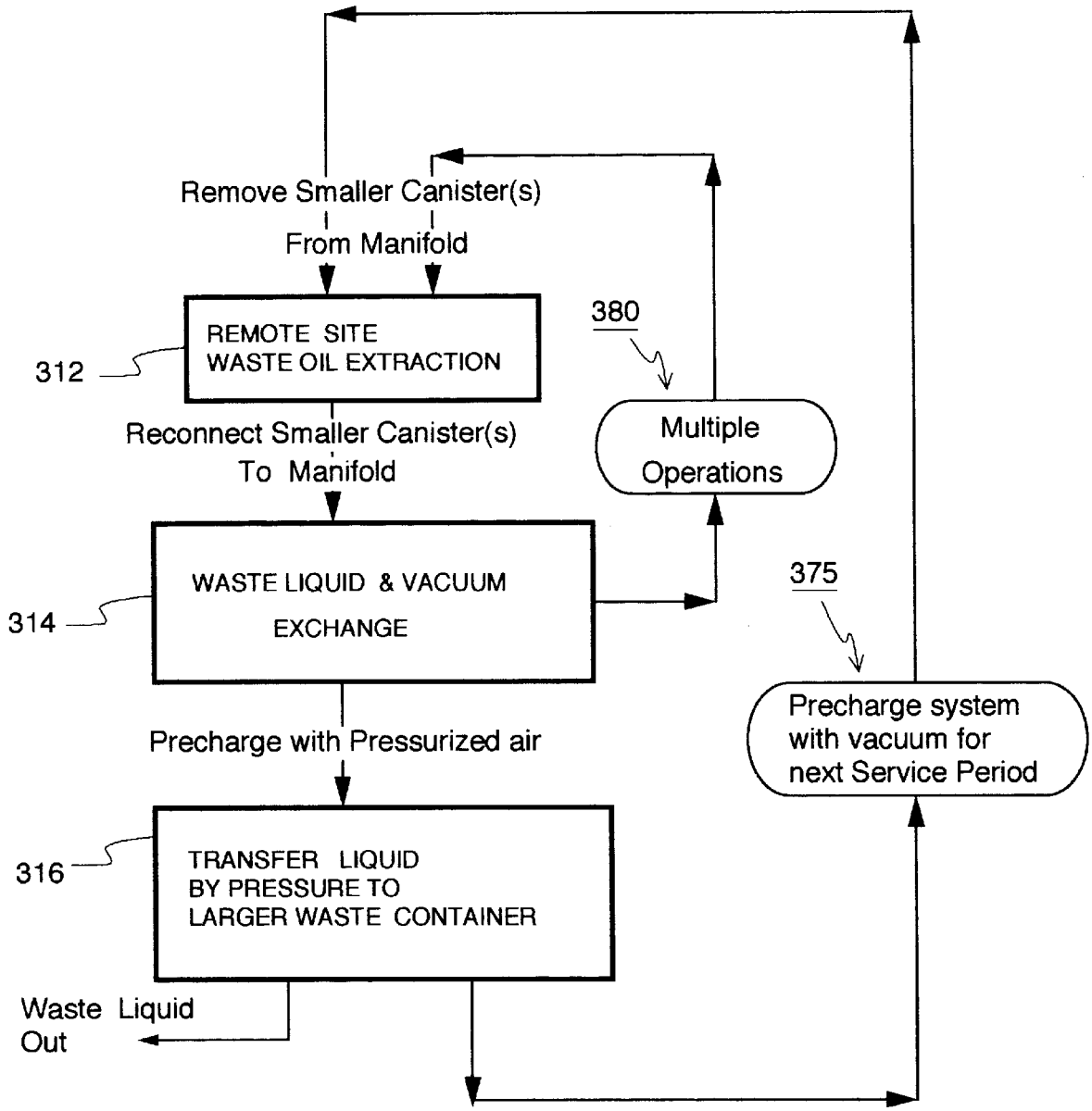
FIG. 7 is a flow chart presentation useful in promoting a clearer understanding of the invention.

Moving to FIG. 7, a block diagram or flow chart of system 275 functions and usage is shown. Inner feedback loop 380 represents the recharging of the smaller canisters 122, from the larger intermediate canister 2. System 275 has thus been able to perform functions 312, 314, and 380 multiple times in the field without external power, and exposure to the atmosphere.

The outer feedback loop 375 represents the initial charge, an operation whose frequency would only occur between service periods (nominally several days) and would occur after an ultimate pressure evacuation step 316 for the entire system, thereby emptying all waste liquid. The flow chart and legends are believed to be self explanatory and thus require no further explanation.

Figure 8:
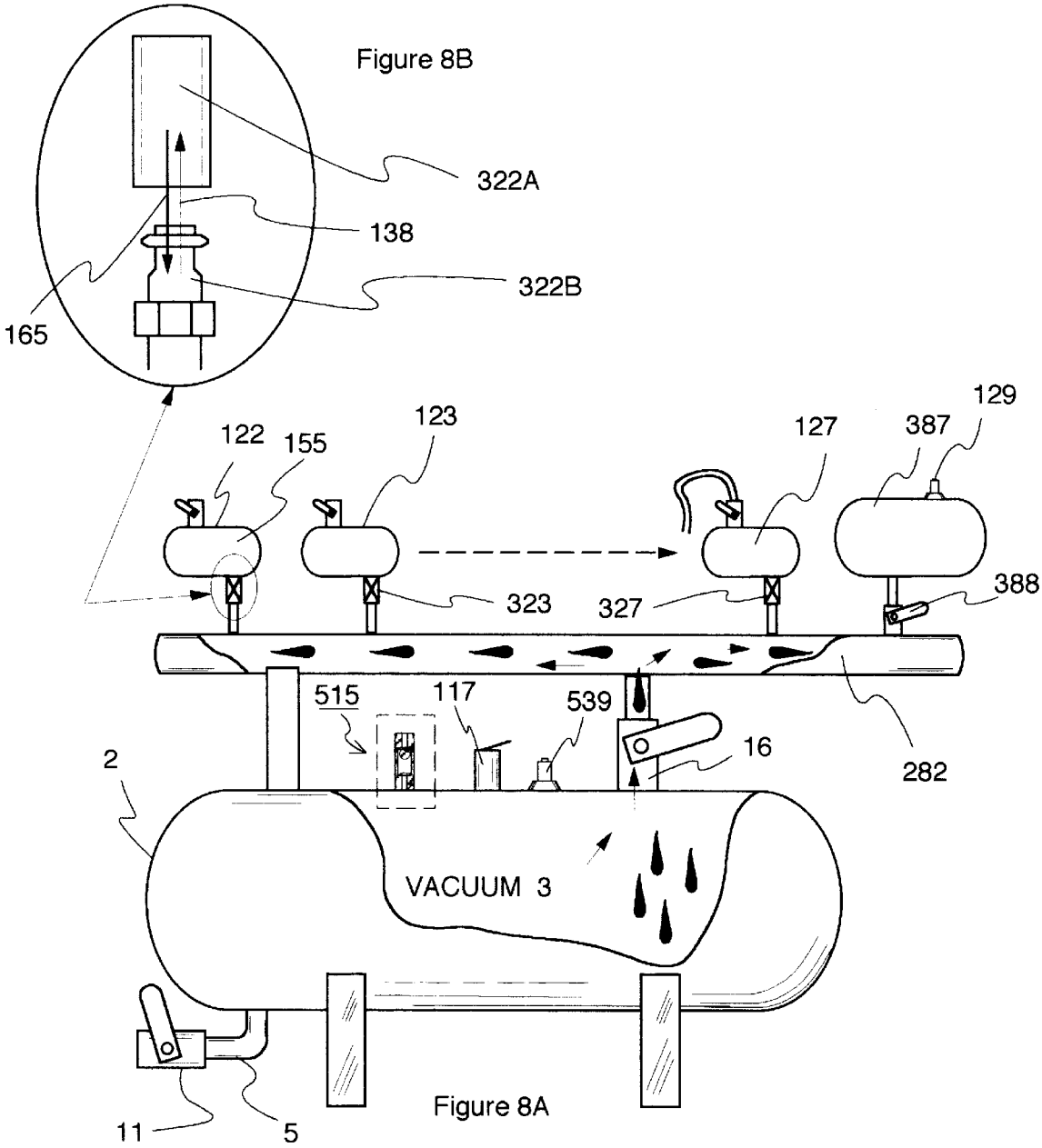

I have also developed a system configuration which may use a manifold 282 FIG. 8 wherein several Slurper™ units 122 through 127 may easily be connected and disconnected to the larger intermediate tank 2 as desired. (While the overall system vacuum evacuation time is increased proportionally, such an increase is not significant considering the service period flexibility that is created. For example, with a family of smaller canisters as shown in 8A, more than one technician may work with system 275 in the field during one service period.)

In such a manifolding configuration hose 82, and valve 211 (FIG. 4) may all be incorporated within a single hydraulic quick disconnect coupling. (See, for example, FIG. 8B.) Obviously, the manifold may be single or double in nature (FIG. 10) depending upon vacuum or pressure modes.

Smaller commercial Slurpers™ heretofore have been sized as five gallon models. These minimum sizes are three to five times larger than most sumps, however the extra capacity provides the user with enough vacuum for three or four independent field uses. With my invention, smaller canisters can more closely approach the size of expected sumps. This size flexibility provides the user with the option of suctioning at a remote site in a self tending mode wherein the smaller canister simply withdraws all of the oil, and then loses its remaining vacuum.

By comparative example, if a six quart sump is being serviced, a smaller canister 122 may now only need be eight quarts. When used in the self tending mode above, an eight quart canister would only introduce two quarts of air to system 275, rather than fourteen quarts for a standard five gallon Slurper™.

Figure 10:
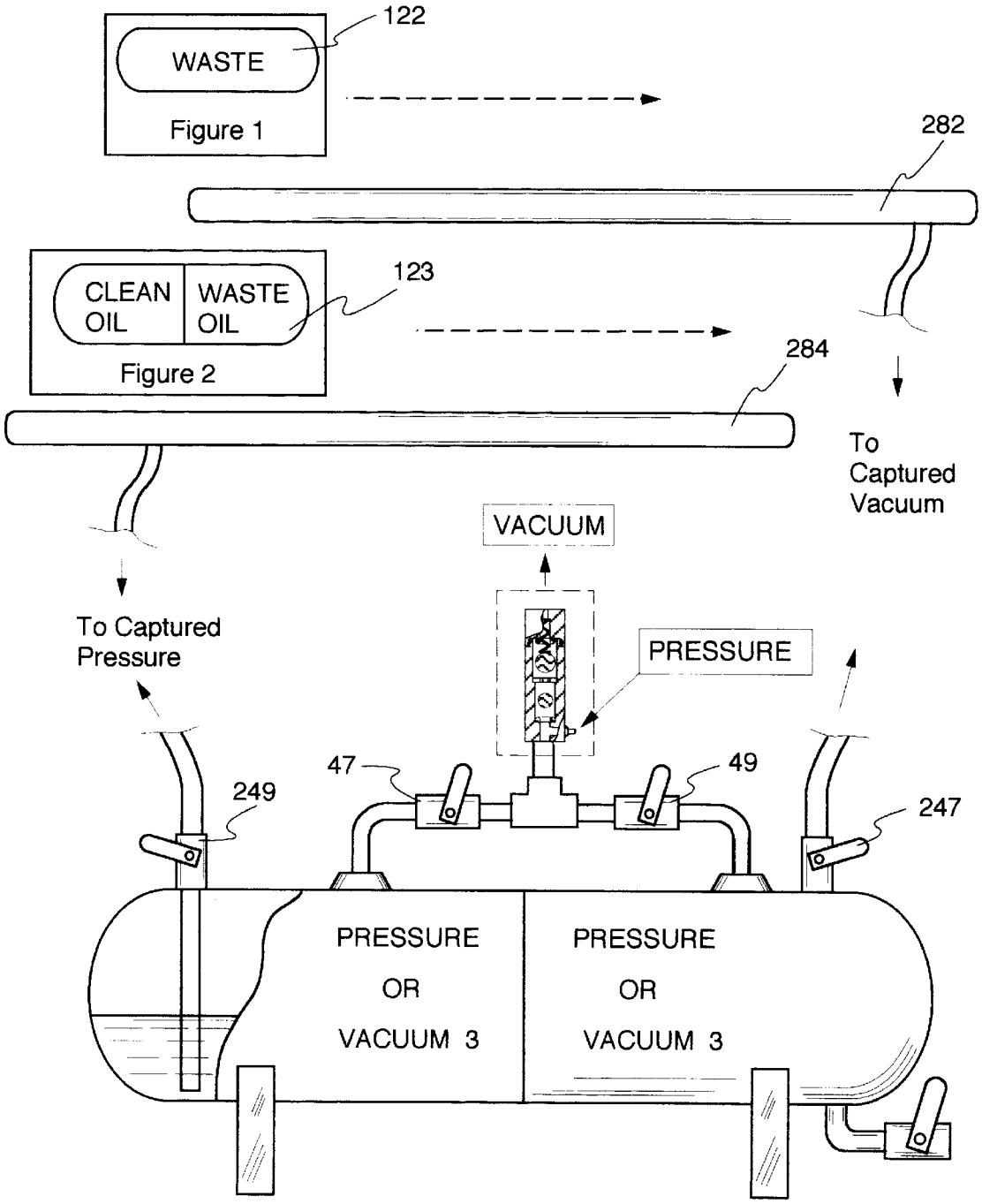
FIG. 10 is a manifolded two-compartment system with a self-tending pressure or vacuum valve.

With multiple smaller canisters, more than one technician may use system 275 in the field during a service period. Smaller canisters 122, 123, etc. may also be of differing sizes, and one or more orifices or a mix of one or two compartment models such as diagrammatically shown for canister 122 as compared to canister 123 (FIG. 10). These apparatus options further improve overall system efficiency.

Perhaps practical field operational numbers will further clarify the very high percentage fill capabilities of my invention. Assume that intermediate canister 2 has a volume of 50 gallons and each of four separate smaller canisters has a volume of 5 gallons. The total volumetric system capacity is thus 50 plus 20, for a total of 70 gallons. If one starts the system at a near absolute vacuum—and operates the system in its most efficient mode—then one can service at least 63 gallons (90%) of waste liquid during one service period.

Operationally, my liquid/vacuum exchange has at least 90% plus fill capability with multiple, time-separate exchange operations. Further, efficiently used, the suctioning force (or vacuum) available to the user is near constant throughout most of the system capacity. Hence, even a relatively small parent tank of 50 gallons or less will perhaps provide more containment and vacuum recharging than needed for an average service day of mobile oil changes at a marina or similar facility.

Also as diagrammatically shown in FIG. 8A, one of the smaller canisters 129 may be dedicated to pressurized air, forming a pressure module 129 for mobile system 275. Canister 129 may then supply a precharged pressure assisted liquid expulsion of a near full intermediate canister at the end of a service period. Remembering the mobility of the system, by turning a few valves, the pressurized air within module 129 is accomplished without the encumbrance of traditional air compressors, hoses, and their associated proximity constraints.

Hence, system 275 is capable of field suctioning multiple times, recharging hand portable Slurpers™, sealably receiving waste liquid of over 90% of volume, and performing pressurized final waste transfer, all without benefit of external power.

In any operation using apparatus and manual valves the possibility of operator error exists. I have discovered and incorporated in system 275 a self tending valve 515 which virtually eliminates the possibility of user error causing vacuum loss in the field. My valve does so by effectively "sensing" whether vacuum is being applied or whether pressure is being applied. As a side benefit, this self tending valve, significantly reduces the number of parts and plumbing required when compared with the manual valve assemblage. Additionally, it provides an automatic operation and thus is safer and far more practical from an overall system standpoint.

Such a self tending valve 515 is shown in cross section in FIGS. 9A through 9D. This self-tending valve 515 is a dual function (pressure or vacuum) valve for attachment to a canister which may operate with either vacuum or pressure. Thus, in some embodiments of my invention, I have replaced the three way isolation valve 55 and vacuum and pressure check valves 24 and 124 (see FIG. 3, for example) with my self tending valve 515.

My self-tending pressure/vacuum control valve 515 may be used in either a one check ball or two separate check ball configuration, depending on the desired threshold response and physical layout requirements. This self tending valve 515 also eliminates the connection plumbing associated with the manual three way valve and check valve assemblies of FIG. 3, for example.

Although my two-port self tending valve may at first glance be superficially similar in appearance to commonly known three port "shuttle" valves, new structure and functions are achieved by a novel chamber and port configuration. This new configuration effectively "senses" and captures either vacuum or pressure above a threshold minimum. Such functions simply are not possible with shuttle valves. Furthermore, shuttle valves only redirect the flow of pressurized air by receiving pressurized air into one port, and then directing it through one or the other of the remaining ports. Hence, the shuttle valves redirects but does not have any structure for capturing either pressure or vacuum flow.

Before examining the element by element operation of my valve 515, it is important to note that such a self tending valve, if not properly designed may suffer from a false seal at the initiation of the vacuum mode which, in turn, would inhibit the vacuum process. This false seal problem is solved by my valve 515 in a manner which will be made clear hereinafter. Also, as background, it is important to further note that the capabilities of my self tending valve will become clearer if one considers its operation in an example using rounded vacuum and pressure amount(s).

An example using rounded numbers perhaps best explains the one and two ball differences, as well as the novel functions of the valve itself. Atmospheric pressure at sea level is 14.7 Pounds per Square inch or 29.92 inches of Mercury, either of which may be used to define an absolute vacuum at sea level. Rounding these to 15 psi and 30 inches, and using a check ball cross section of one (1) square inch, for simplicity of arithmetic, we can more quickly proceed through the various functions and threshold trade-offs provided by my self tending throughput and capture valve.

Figure 9A:
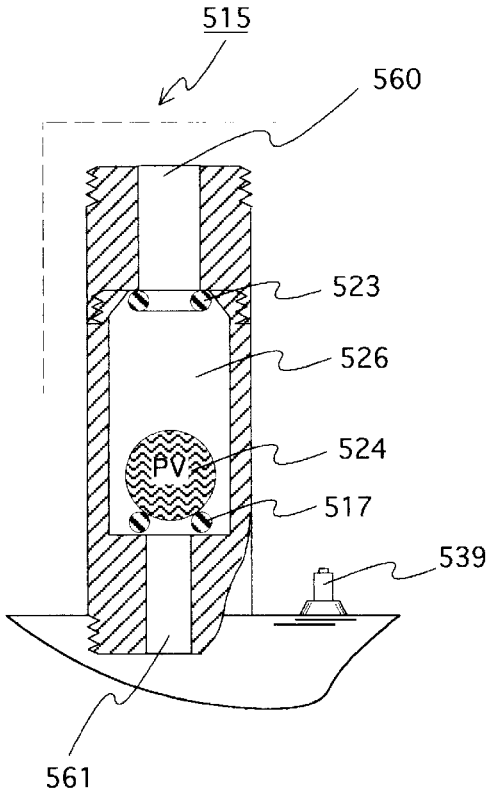
FIG. 9 includes FIGS. 9A through 9E and presents embodiments of a one or two ball self tending valve, with FIG. 9A and 9B showing a single ball configuration.
FIGS. 9C through 9E showing a two ball embodiment.
Figure 9B:
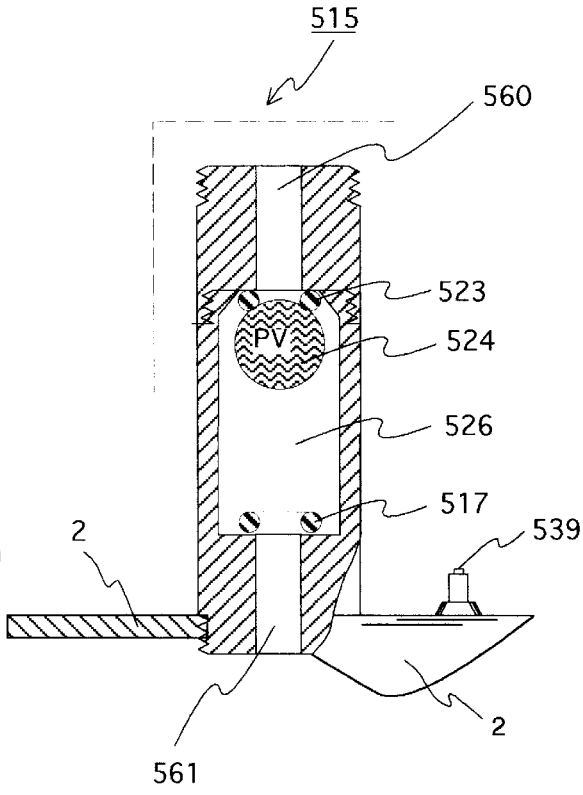

Moving now to FIG. 9A, we will examine the very start of the vacuum pump down process by assuming that vacuum pump 18 (not shown—but see FIG. 3) near instantaneously pulls 30 inches of vacuum. Hence, at that first moment of attachment to port 560 (FIG. 9A), there is a full vacuum or (0) zero absolute pressure within chamber 526, and hence, above check ball 524. At this same instant in time and inside port 561—and in communication with tank 2—there is standard atmospheric pressure (15 PSI) below ball 524. Hence, ball 524 is subject to an upward force of 15 pounds per square inch. That force, and or the reaction to that force, must somehow be overcome to avoid an undesired closure against upper seal 523. Such a closure would totally stop the vacuum process and we will not achieve the desired vacuum in tank 2.

The structure for overcoming this unwanted impulse reaction at the start of the vacuum process involves careful design selection of several parameters. Those parameters involve the weight of the ball 524, the respective diameters of ports 560 and 561 as well as the volume of chamber 526. We assume in our design that top port 560 is always selected with a diameter that is smaller than the diameter of the bottom port 561. By way of further explanation, if the chamber 526 were only a few thousandths of an inch larger in diameter than the diameter of ball 524, then, during the first moment of the vacuum mode, this 15 psi differential pressure could lift check ball 524 on impulse (FIG. 9B) and hold it upwardly against top seat 523 creating the previously discussed undesirable closure.

If however, the diameter of chamber 526 were significantly large in cross sectional area compared with the diameter of check ball 524, then ball 524 will only lift sufficiently from bottom seat 517 so that the air being withdrawn from within tank 2 can be extracted by vacuum pump 20. As an example, check ball 524 may simply roll slightly to the side, but thereby creating an immediate drop in pressure occurring around ball 524. This process thereby allows the desired air passage throughout the vacuum pump down process. Ball 524 would then re-seat against 517 when vacuum source 18 is removed from port 560, so as to capture the desired vacuum in tank 2. This reseating is the well known function of a vacuum check valve.

Accordingly, a single ball self tending valve 515 must have a check ball 524 of some reasonable weight (such as a steel ball). In other words, the ball 524 may not be featherweight because it would react to the impulse and erroneously close in the vacuum mode for the reasons earlier described.

After a user withdraws oil from multiple marine engines with the portable small canister(s) 122 and performs multiple waste oil transfers into intermediate tank 2, there comes a point when this larger integrated volume of waste oil 3 must be properly transferred to a larger reclamation tank. System 275 is designed such that, tank 2 may be pre charged with pressure for a pressure assist evacuation. This evacuation procedure requires a pressure mode for intermediate tank 2, and that pressure mode is achieved more reliably with my self tending valve 515.

Valve 515 may or may not incorporate a pressure inlet of any standard type. For example, in FIG. 9E, the pressure inlet 539 is shown as part of valve 515. It need not be however. Thus, in FIGS. 9A through 9D, the pressure inlet 539 is threaded directly into the tank 2. In any event, however, my self tending valve and system operation will automatically capture the pressure for a pressure mode.

In certain system design configurations, one may wish to mount a valve other than vertical and/or wish not to be concerned with port sizes or ball weights as design parameters. In such cases, I have developed a two ball configuration as shown in FIG. 9C, 9D, and 9E for vertical or non-vertical mounting.

Figure 9C:
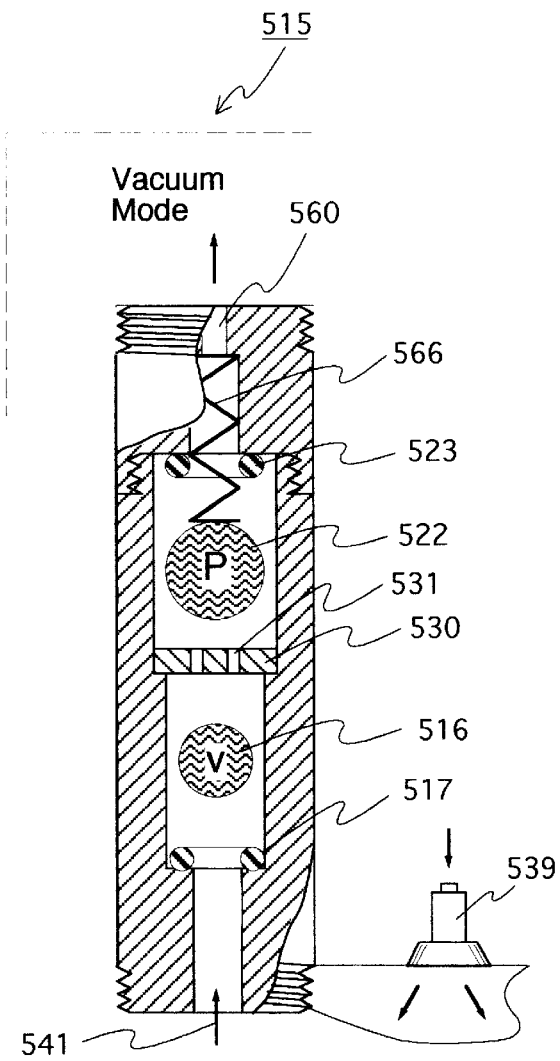
Figure 9D:
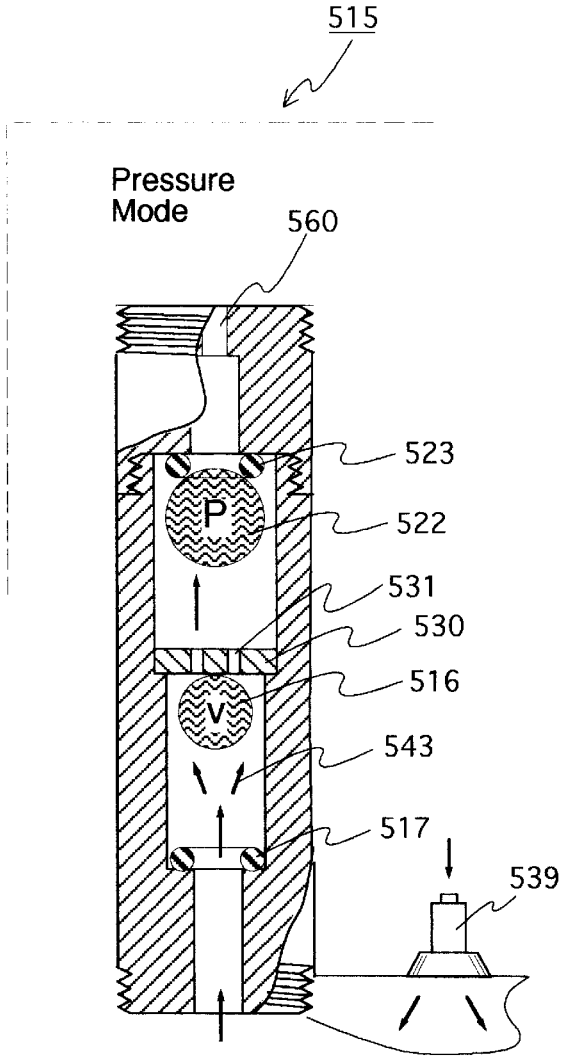
Figure 9E:
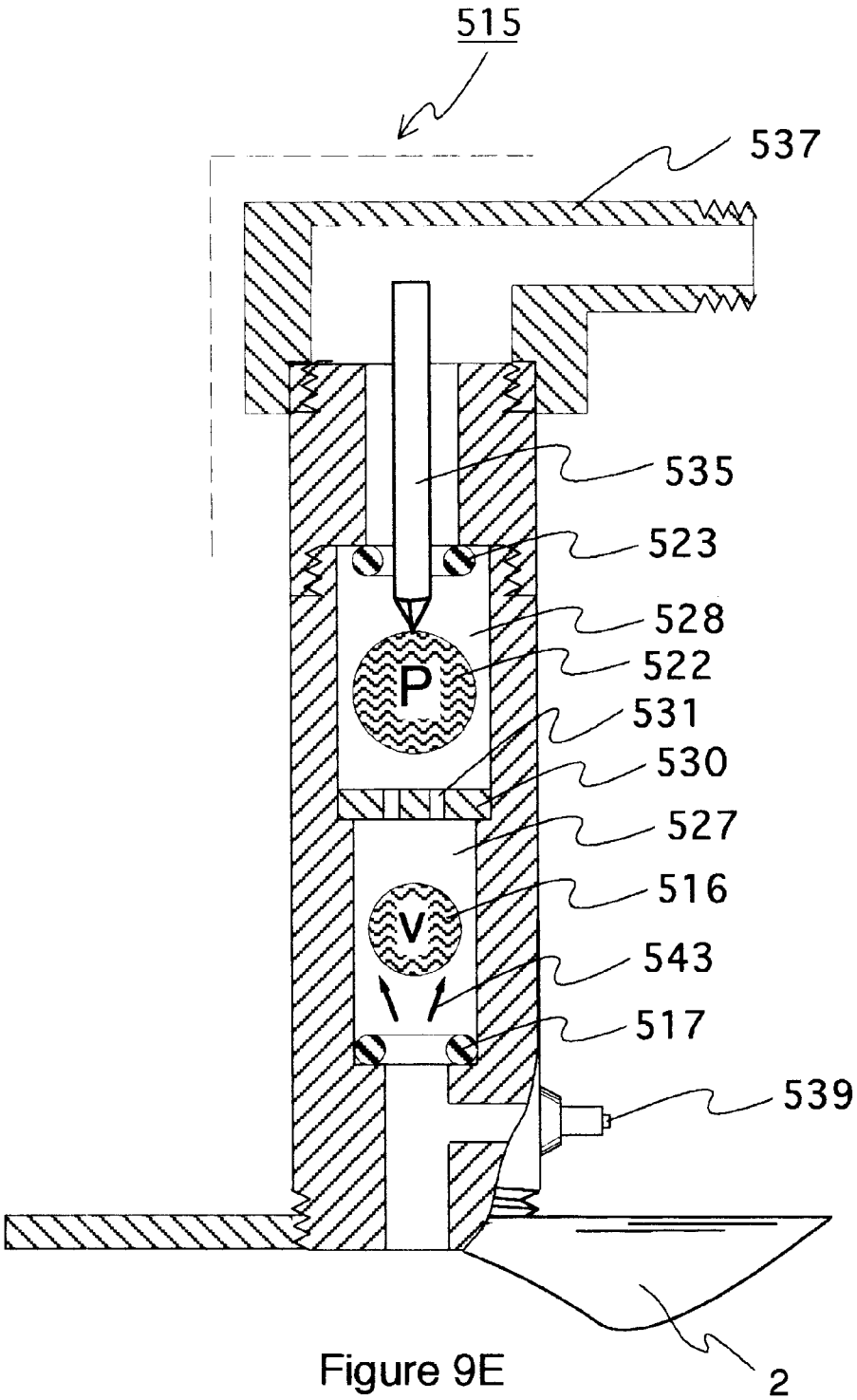

In the two ball version of FIG. 9C through 9E, we have two chambers—vacuum and pressure—separated by a spacer 530 having air inlet passages 531 provided therethrough. Spacer 530 provides throughput in the vacuum mode via openings 531, yet totally isolates vacuum check ball 516 from a false closure. Thus, check ball 516 may be "light as a feather" thereby providing a very low air throughput resistance to the volumetric flow rate for achieving the same vacuum in tank 2 as vacuum pump 18 is capable of providing. (In a one ball valve as described earlier, ball weight does reduce top end vacuum. Hence, a two ball valve eliminates this short fall.)

Top ball 522 (shown seated, in a pressure mode, in FIG. 9D) must have enough resistance to the previous example of a momentary 15 psi differential so as to inhibit a false closure during the vacuum mode. Embodiments 9C, 9D, and 9E all provide the necessary resistance, either by light weight spring 566 (FIG. 9C) or by a carefully selected ball weight only (FIG. 9D), or by a weighted dowel 535 (FIG. 9E). (Note for example in FIG. 9C, the spring resistance is of a configuration exactly opposite to standard check valves, ie. the spring is on the opposite side of the ball to a normal check valve.) Note also that the dowel configuration shown in FIG. 9E is oriented in the vertical for maximum advantage of dowel weight and is further assembled within a standard street el 537 which provides clearance, yet contains the dowel itself.

In all embodiments, top seat 523 provides the means for capturing and holding pressure in the pressure mode. In the pressure mode, my self tending valve "vents" at pressures below about 15 PSI due to ball weights, dowel weights, or spring forces. However, tank 2 liquid volumes will be expelled when operating in the pressure mode, before the system reaches a low end threshold pressure of 15 psi.

To summarize, in a single ball self tending valve, in the vacuum mode, check ball weight is a factor in keeping the ball from a false closure in a vacuum mode. Check ball weight also sets the lower limit of pressure to be captured in the pressure mode. Likewise ball weight affects the maximum vacuum which may be captured. In a two ball configuration, however, my self tending valve will capture effectively all of the applied vacuum. (In other words, there is no system vacuum loss due to ball weight.)

While my invention has been described with reference to a particular example of a preferred embodiment, it is my intention to cover all modifications and equivalents within the scope of the following claims. It is therefore requested that the following claims, which define my invention, be given a liberal interpretation which is within the spirit and scope of my contribution to this art.

What is claimed is:

1. A fluid handling system for movement of fluid relative to a sump, said system comprising:

one or more individual canisters each capable of holding a captured vacuum for use in withdrawing said fluid from a sump and self containing said fluid therein;

a separate container having a captured high vacuum for supplying said high vacuum to a canister and for receiving therefrom sump fluid to be stored in said separate container; and connecting means between said canister and said container for near simultaneously transferring said fluid and vacuum between the separate container and said canister.

2. A system in accordance with claim 1 wherein said fluid is a waste liquid and said system further comprises:

a system which is sealable and closed to the outside atmosphere for vacuum exchange and waste liquid transfer; and said connecting means is manually operable for removably connecting said canister to said container for said simultaneous vacuum and waste liquid transfer.

3. A method of using the system of claim 1 wherein said separate container has a larger volume than an individual canister and said method comprises the step of:

borrowing vacuum in small quantities via said connecting means to and from a larger contained vacuum in said separate container; and concurrently exchanging small quantities of fluids between said canister and the separate container.

4. A method of using the system of claim 2 wherein said separate container has a larger volume than an individual canister and said method comprises the additional steps of:

withdrawing and capturing in said individual canister a waste liquid from a sump; and said connecting means comprises means for sealably closing said entire system to the outside atmosphere.

5. The system of claim 1 wherein said separate container is an intermediate container and said connecting means is characterized by comprising:

a gravity drain positioned between said smaller canister and said intermediate container.

6. The system of claim 5 wherein said gravity drain is further characterized by comprising:

positioning means for holding said smaller canister with a lowest drain of said canister being located above a highest inlet of said intermediate container; and said connecting means comprises fluid coupling means connected between said canister drain and said inlet of said intermediate container.

7. The system of claim 2 wherein said connecting means of said closed system is further characterized by comprising:

one or more valve means selectively operable for opening a fluid conducting means for vacuum and/or waste liquid exchange between the smaller canister and said intermediate container.

8. The system of claim 2 wherein said closed system is further characterized by removing waste liquid in said intermediate container by pressure stored in said intermediate or seperate container, and said system further comprises:

a self-tending valve connected to said intermediate container for automatically capturing either vacuum or pressure in said intermediate container.

9. The system of claim 8 wherein said self-tending valve eliminates the requirement for a manual valve operation by a user desiring to switch from a vacuum mode to a pressure mode for said intermediate container, and said system further comprises:

a fluid path through said self tending valve with sealable seats and seat closing means for automatically capturing and holding, in the intermediate container of the system, either vacuum or pressure above a threshold pressure amount.

10. The system of claim 8 wherein said intermediate container includes separate inputs for pressure and vacuum, and said seat closing means in self-tending valve comprises:

a ball gate for capturing a vacuum in said intermediate container; and means associated with said ball gate for avoiding a false closure of said ball gate when a vacuum is applied to said vacuum input.

11. The system of claim 10 wherein said false closure avoidance means of said self-tending valve comprises:

a sealable top and bottom port for said fluid path, with said top port being sized smaller than the bottom port, which bottom port is connected to the container; and said ball gate having a weight selected to avoid impulse lifting when vacuum is first applied to said top port.

12. The system of claim 10 wherein said false closure avoidance means of said self-tending valve comprises:

a sealable top and bottom port for said fluid path, with said top port adapted for connection to a vacuum source and the bottom port being connected to the container; and spring means or a sliding weight located between said top port and said ball with said spring/weight having sufficient downward force to hold said ball in an unseated position relative to said top port to avoid an impulse closure tending to be caused by an upward impulse force.

13. The system of claim 12 wherein said self-tending device comprises:

a calibrated threshold means for causing the pressure capture portion of said valve to remain dormant in a vacuum mode; and pressure retaining means associated with said threshold means for capturing said pressure in said container at, or above, said pressure threshold amount.

14. The system of claim 13 wherein said threshold means of said self-tending device comprises:

a spring or a sliding weight having a predetermined weight equal to the force of said pressure in said container.

15. The system of claim 10 wherein said self-tending device further comprises:

a pressure capturing and a vacuum capturing chamber each having check balls and ball seats.

16. The system of claim 15 wherein said self-tending device further comprises:

said lower ball is a vacuum capturing ball and seats against a corresponding ball seat for capturing a desired vacuum in said container.

17. The system of claim 15 wherein said self-tending device further comprises:

an upper pressure capturing ball and corresponding ball seat;

a lower vacuum capturing ball and corresponding ball seat for capturing a desired vacuum in said container; and said chambers being separated by a divider which is configured with air passages and each of said balls being contained within its own chamber.

18. The system of claim 16 wherein said self-tending device, as a vacuum is attained in the valve chamber, further comprises:

said lower ball operating as a high vacuum check valve by seating itself against its seat in order to capture the attained vacuum in the container; and said upper ball has a calibrated spring mounted above the ball and between said upper ball and its seat for holding an attained pressure in said container when said pressure collapses said spring and seats said ball against its seat.

19. The system of claim 17 wherein said self-tending device, as pressurized air is infused into the intermediate container, further comprises:

the pressurized air acts upwardly against said upper ball and overcomes the spring and sealably seats same against its seat to thereby capture the pressure in said container tank; and said lower ball also moves upwardly during pressurizing, then rests loosely on its seat by gravity and does not contribute any function in this pressurized mode.

20. The system of claim 6 wherein said canister is hand portable, vacuum sealable and controllable for suctioning waste liquid from an external sump, for self containing the withdrawn liquid, and for transporting said captured waste liquid in said canister (s) by hand to the intermediate container;

said system being further characterized by comprising:

an open/close valve on said canister for capturing a high vacuum therein;

a manually operable valve means for controllably exposing the captured vacuum in said canister to waste liquid to be suctioned from said sump;

a connecting hose located between said manually operable valve and the sump; and transfer means connected between a drain for said canister and an inlet for said intermediate container.

21. A system comprised of:

at least one sealable intermediate canister and one or more sealable portable canisters of differing volumetric size and differing partial vacuums;

means for gravity liquid exchange between said intermediate and portable canisters; and means for vacuum equalization by a vacuum exchange between said portable canisters and said intermediate canister.

22. An apparatus recited in claim 21 wherein each canister within the closed system may contain both vacuum and liquid and the system further comprises:

means for simultaneous vacuum exchange between two independent partially evacuated canisters wherein both may also contain differing amounts of liquid and differing levels of vacuum as well.

23. A fluid transfer method of exchanging liquid and vacuum in a closed system without exposing either liquid or vacuum to the atmosphere, said method comprising the steps of:

containing a first vacuum and a liquid in a first sealed container;

separately containing another liquid and second vacuum in a second sealed container;

interconnecting the first and second sealed containers by a single liquid and vacuum conduit; and feeding liquid between the first and second containers through said conduit as the respective vacuums in said containers self-equalize.

24. The method of claim 23 wherein either or both of the containers may have a partial fill of liquid, and comprising the further method step of:

placing the second container at a lower elevation than the first container;

establishing a positive pressure in the second container relative to the first container; by the introduction of ambient air into said second container; and relying on that positive pressure to run liquid uphill through said conduit to said first container.

25. The method of claim 23 wherein either or both of the containers may have a partial fill of liquid, and wherein said feeding step further comprises:

relying on gravity working within a vacuum from a higher location of said first container relative to said second container for said liquid exchange.

26. The method of claim 23 wherein said containers may have a partial fill of liquid and said second container is a series of separate individual canisters and said method comprises the further step of:

coupling the individual ones of said series of canisters to said first container by a common shared conduit; and exchanging liquid and vacuum between said first container and any one or all of said individual canisters of said canister series.

27. The method of claim 23 wherein said canisters may have a partial fill of liquid and said method comprises the further step of:

exchanging the same total liquid and vacuum as though said canister series and said second container were the equivalent to a single large tank volume.

28. The method of claim 23 wherein said liquid in said first container is of such viscosity as to have a reduced exchange speed, and said method further comprises:

controllably exhausting the vacuum in said first container and thus reducing the net vacuum of the closed system in order to increase the speed of liquid exchange between the first and second container.

29. The method of claim 27 wherein said method step for increased exchange speed further comprises:

developing a greater differential vacuum between the first and second containers in order to achieve said increased exchange speed for liquid transfer at a relatively small loss of vacuum for the total system.

30. An apparatus and system for portable transferring fluid from an external sump to an intermediate canister, and later in time from the intermediate canister to another waste receiving reservoir, said apparatus comprising;

a pre-chargeable, sealable intermediate canister which may be evacuated to form a near absolute vacuum captured in the intermediate canister when the canister is disconnected from a vacuum source, and which canister may also be pressurized to capture and hold a positive pressure in said canister when the canister is disconnected from a pressure source;

one or more pre-chargeable, sealable, smaller canisters which may be placed in temporary fluid and/or vacuum communication with said intermediate canister after said intermediate canister has been vacuum pre-charged; and closed system configuring means for exchanging both vacuum and fluid contents between said smaller canister and said intermediate canister.

31. A self-tending pressure or vacuum capture valve adapted for throughput connection to a container, which container may hold either a predetermined amount of vacuum or pressure, said valve comprising:

a throughput path for applying either a vacuum or for closing against an applied pressure in the container;

sealable port closure means operative for automatically capturing in said container either vacuum or pressure; and inhibiting means causing said closure means to remain dormant during evacuation of the container in a vacuum mode and yet operative, when the desired vacuum or pressure has been attained, for capture of said predetermined vacuum or pressure amount.

32. A self-tending pressure or vacuum capture valve in accordance with claim 31 wherein said throughput path has a pair of ends, and said valve further comprises:

a pair of opposing sealing seats located at each end of said throughput path; and said capture means sealably closes against one of said seats for sealing pressure in said container and closes against the other seat for holding a desired vacuum in said container.

33. A self-tending pressure or vacuum capture valve in accordance with claim 32, said capture means of said valve further comprises:

at least one ball movable in either of two directions for vacuum or pressure sealing at an appropriate seat and thereby interrupting said throughput path.

34. A self-tending pressure or vacuum capture valve in accordance with claim 33, said capture means of valve further comprising:

said ball, when seated against said vacuum sealing seat, forming a vacuum check valve and when seated against a pressure sealing seat forms a pressure check valve.

35. A self-tending pressure or vacuum capture valve in accordance with claim 31, said capture means of valve further comprises:

a pair of balls positioned in said throughput path, with one ball being a pressure sealing ball and the other ball being a vacuum sealing ball;

a pair of seats in said throughput path; and one of said seats being a pressure sealing seat responsive to said pressure sealing ball seating thereon for capturing pressure supplied to the interior of said container and a vacuum sealing seat for capturing vacuum in said container when said vacuum ball is seated against said vacuum sealing seat.

36. A self-tending pressure or vacuum capture valve in accordance with claim 31, wherein said inhibiting means further comprises:

a ball having a weight and/or volumetric flow rate selected to inhibit said capture means during a vacuum evacuation mode but serving as a vacuum check valve when evacuation is completed.

37. A self-tending pressure or vacuum capture valve in accordance with claim 31, said threshold means of said valve further comprises:

a volumetric flow rate spring holding said ball away from said pressure seat during a vacuum evacuation mode but said spring capable of being overcome and acting as a pressure check valve when said threshold pressure amount is exceeded in the interior of said container.

38. A self-tending pressure or vacuum capture valve in accordance with claim 31, said inhibiting means of said valve further comprises:

a sliding dowel and ball having a combined weight for holding said ball away from said pressure seat during a vacuum evacuation mode but said weight being overcome and allowing said ball to seat as a pressure check valve when said threshold pressure is exceeded.

39. A self-tending pressure or vacuum capture valve in accordance with claim 31 wherein said closure means further comprises:

a single ball in a chamber having a top and bottom port in said throughput path.

40. A self-tending pressure or vacuum capture valve in accordance with claim 31 wherein said closure means further comprises:

a pair of chambers formed in said throughput path; and a pair of balls, with one ball each located in one chamber each of said pair for selectively opening or closing said path into said respective chamber.

41. A self-tending pressure or vacuum capture valve in accordance with claim 40 wherein said closure means further comprises:

a divider wall located between said chambers; and air passage holes through said chamber divider wall.

42. A self-tending valve connected to a container and having a pair of communicating ports through said valve and into said container, which container stores pressure and vacuum, said valve comprising:

capture means operative in either a vacuum or a pressure mode for automatically capturing in said container either vacuum or a pressure amount equal to or in excess of a predetermined pressure threshold;

means operative in conjunction with said capture means for causing said capture means to remain dormant during evacuation of the container in a vacuum mode; and said capture means responsive to said threshold means by capturing said pressure in said container when the amount of applied pressure in the container becomes equal to or higher than said predetermined threshold amount.

* * * * *